US006109809A

United States Patent [19]

Pistis

[11] Patent Number: 6,109,809

[45] Date of Patent: Aug. 29, 2000

[54] PAINTING ROLLER

[76] Inventor: Pierino Pistis, Via Papa Giovanni XXIII°, 93, 08023 Fonni (NU), Italy

[21] Appl. No.: 09/337,518

[22] Filed: Jun. 22, 1999

[51] Int. Cl.[7] ..... B05C 1/10

[52] U.S. Cl. ..... 401/197; 401/220

[58] Field of Search ..... 401/220, 44, 197, 401/203–206, 219, 46

[56] References Cited

U.S. PATENT DOCUMENTS 3,549,267 12/1970 Wurzer et al. ..... 401/220

4,217,062 8/1980 Trp et al. ..... 401/44

5,931,595 8/1999 Van Oost ..... 401/220

5,997,205 12/1999 Koide ..... 401/220

*Primary Examiner*—Charles R. Eloshway

*Attorney, Agent, or Firm*—Young & Thompson

[57] ABSTRACT

A painting roller with a roller having an outer painting surface and a device feeding paint to the outer painting surface of the roller so as to keep the outer surface of the roller constantly impregnated with paint.

8 Claims, 7 Drawing Sheets

PAINTING ROLLER

BACKGROUND OF THE INVENTION

This invention refers to a painting roller.

DESCRIPTION OF THE RELATED ART

It is known that the painting rollers must be repeatedly impregnated with paint; moreover, it is necessary to uniformly spread the paint on the roller, for instance by a spreading net.

These operations naturally involve a considerable loss of time, thereby reducing the operator's productivity.

Then again, whenever the roller is impregnated a troublesome dripping problem arises, which soils the operator's clothing and the floor of the premises where the painting is done.

If the operators works on a scaffolding, the container holding the paint hinders the operator's movements, and may even be a source of risk for his safety.

SUMMARY OF THE INVENTION

The primary objective of this invention is to eliminate the mentioned problems, so as to allow completing the painting job in less time, reduce soiling and eliminating hazardous situations.

These objectives are achieved by a painting roller according to the wording of claim 1. Other scopes and advantages may further be attained by a painting roller according to the wording of the dependent claims.

BRIEF DESCRIPTION OF THE DRAWINGS

Embodiments of the painting roller of this invention will now be described, for purely exemplifying and non-limiting purposes, with respect to the enclosed drawings in which.

DESCRIPTION OF THE PREFERRED EMBODIMENTS

Figure 1:
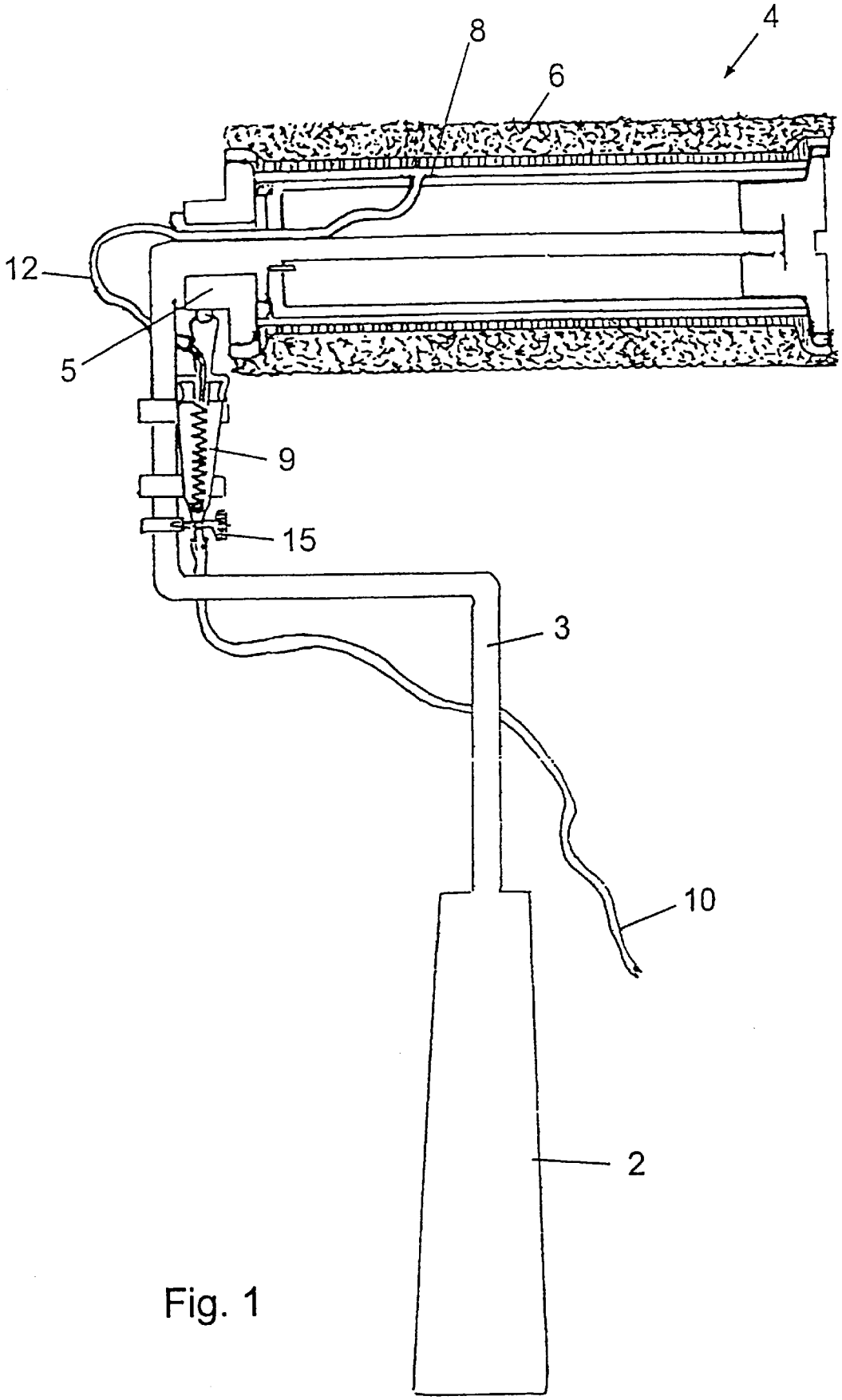
FIG. 1 is a partially sectionalized front view of the painting roller as an object of this invention.
Figure 3:
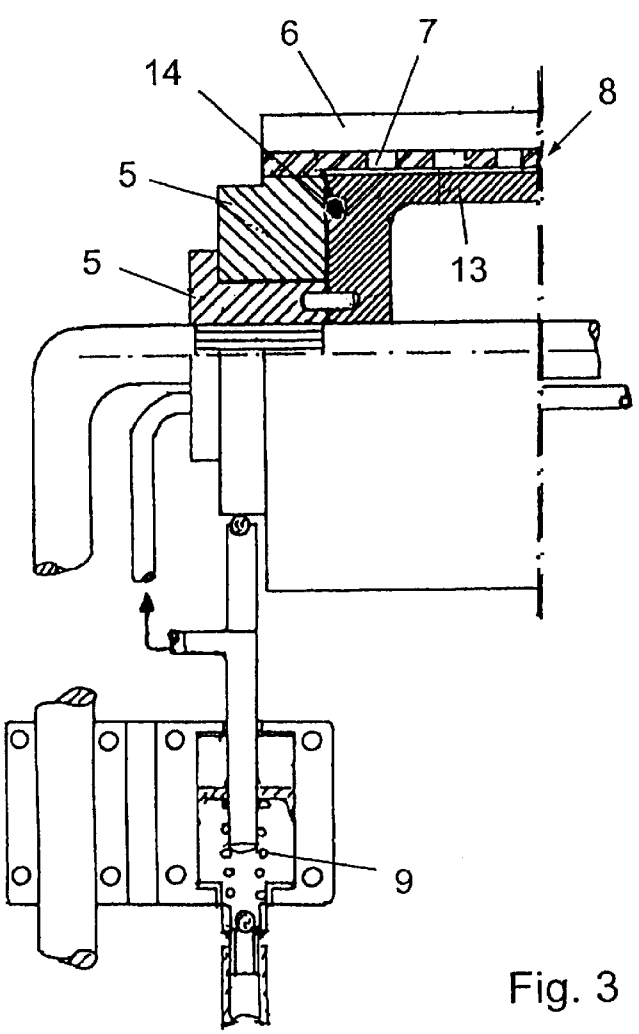
FIG. 3 shows a first enlarged detail of the roller in FIG. 1.
Figure 2:
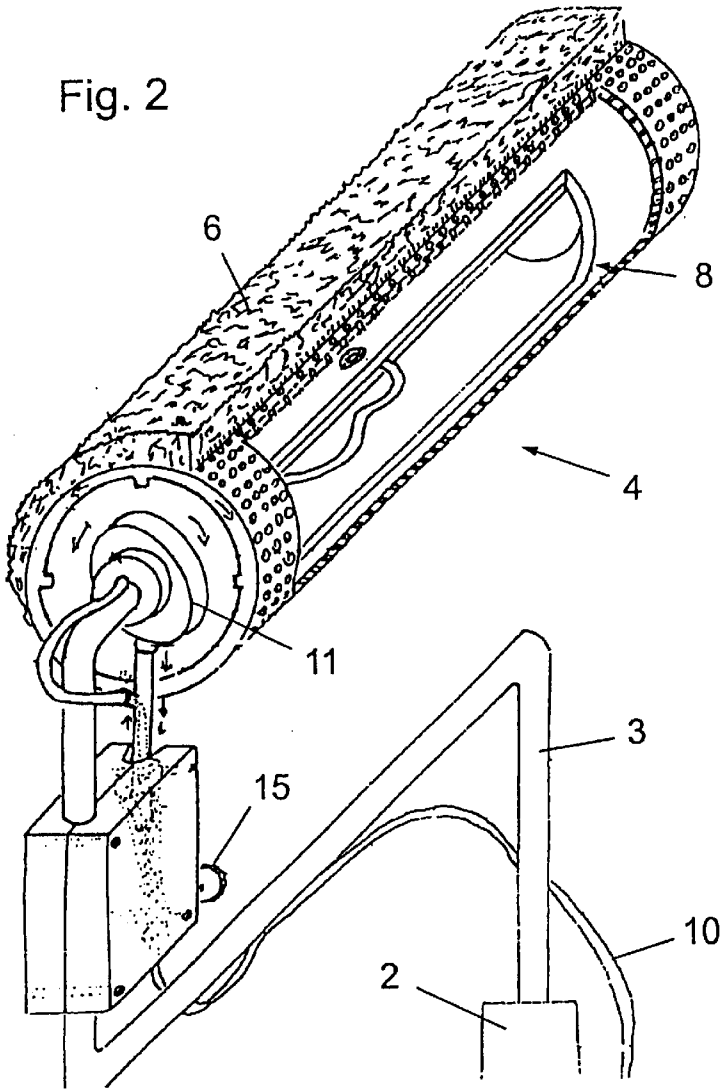
FIG. 2 is a partially sectionalized prospective view of the same roller of FIG. 1.
Figure 4:
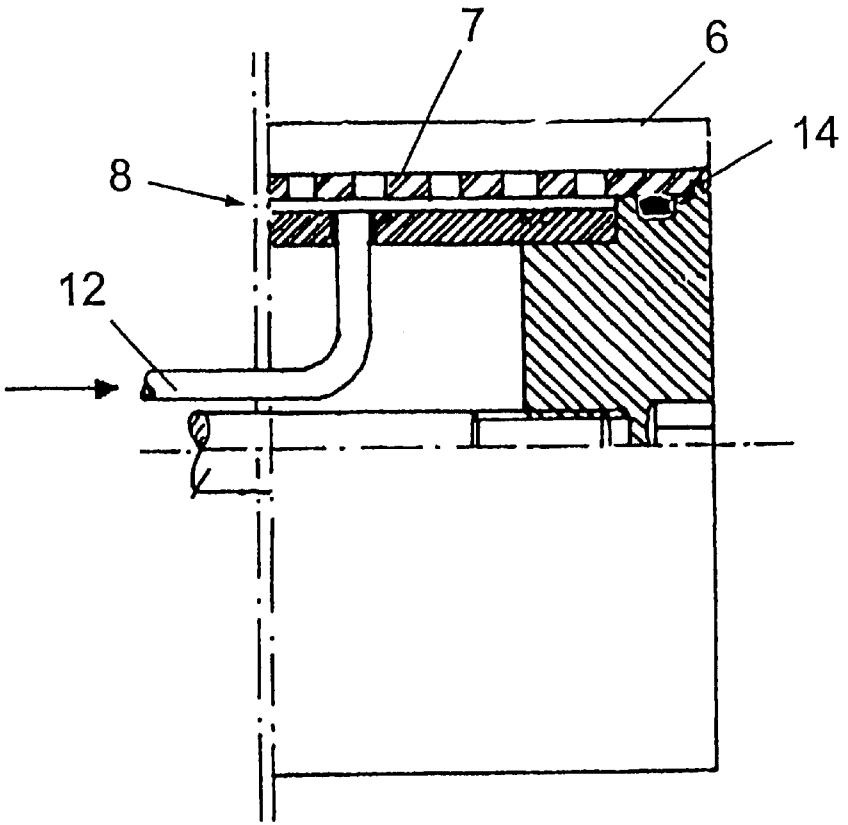
FIG. 4 shows a second enlarged detail of the roller in FIG. 1.
Figure 6:
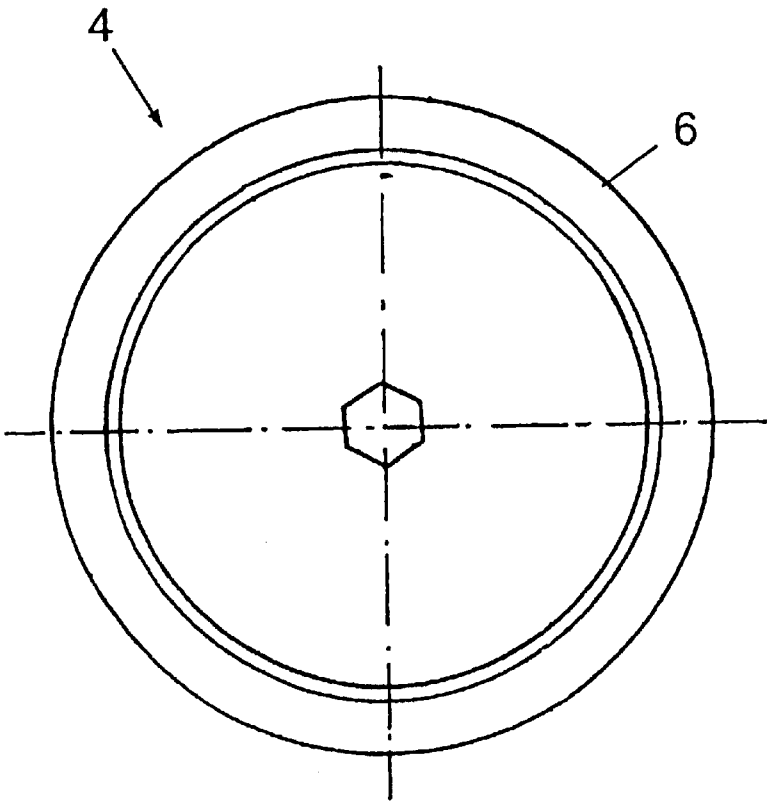
FIG. 6 is another side view of a detail of the roller in FIG. 1.
Figure 5:
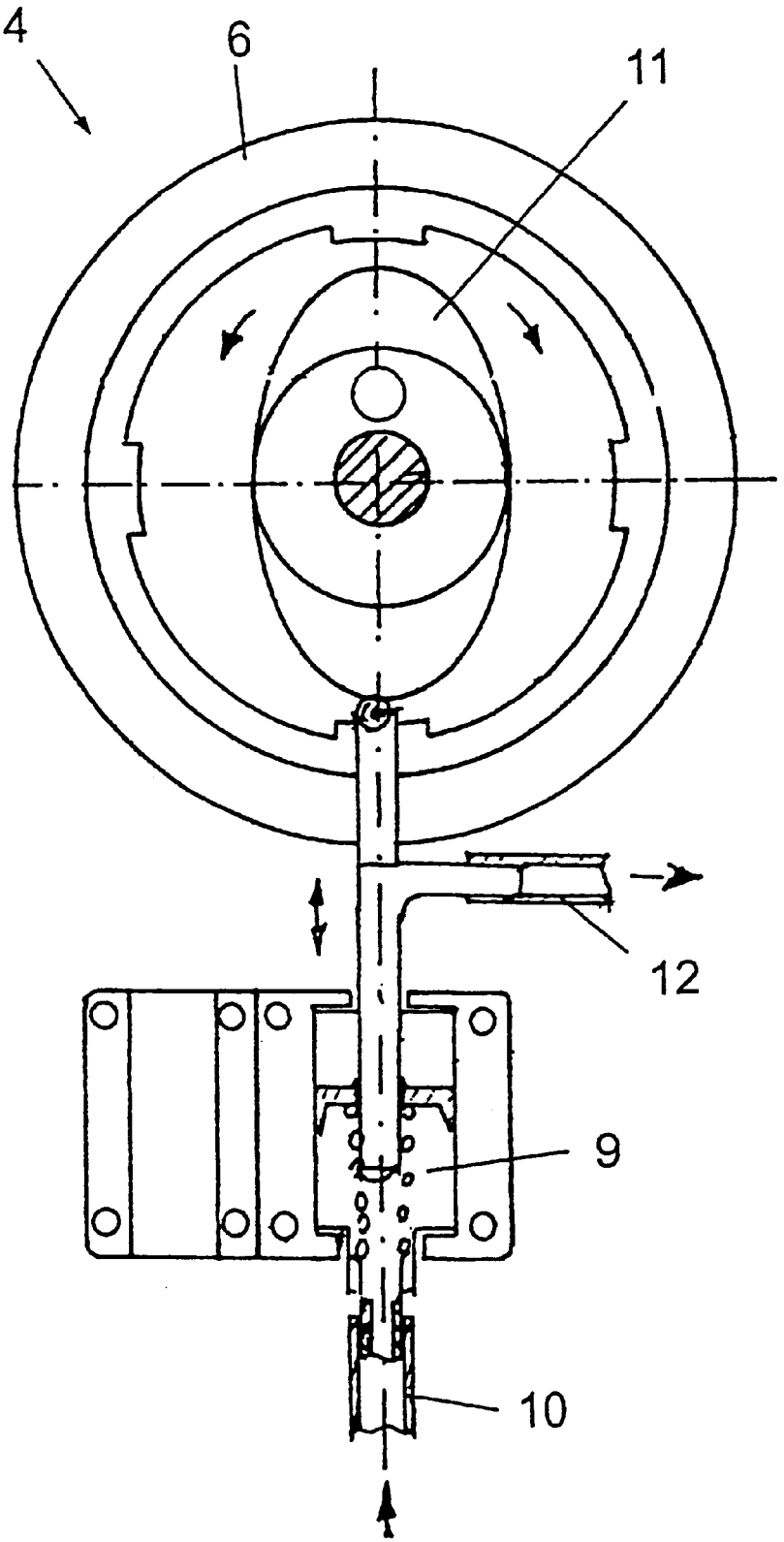
FIG. 5 is a side view of a detail of the roller in FIG. 1.
Figure 9:
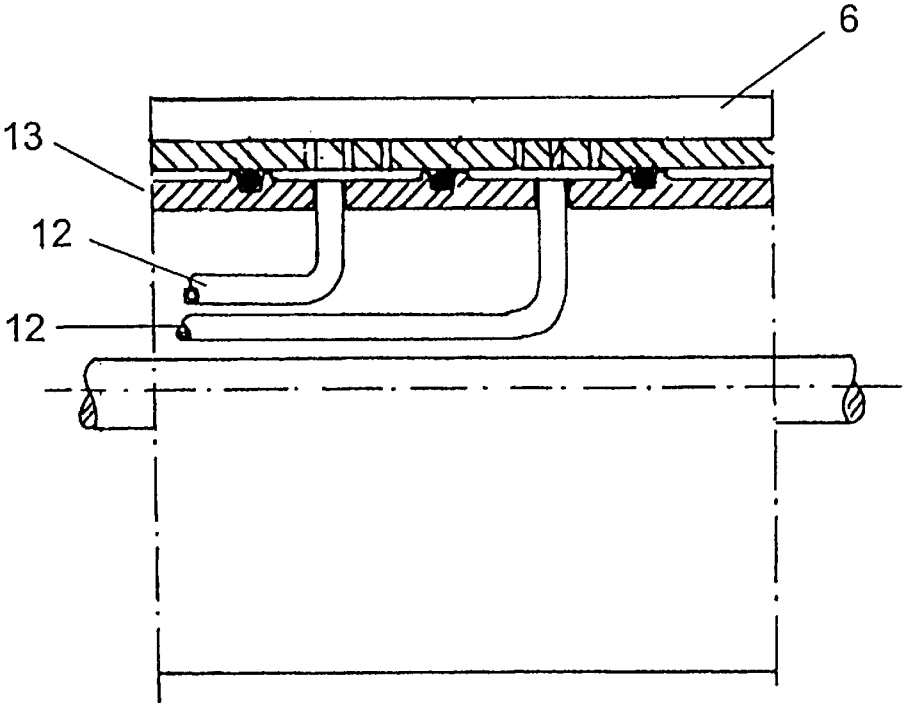
FIG. 9 is a longitudinal cross-sectional view of a detail of the roller in FIG. 7.
Figure 7:
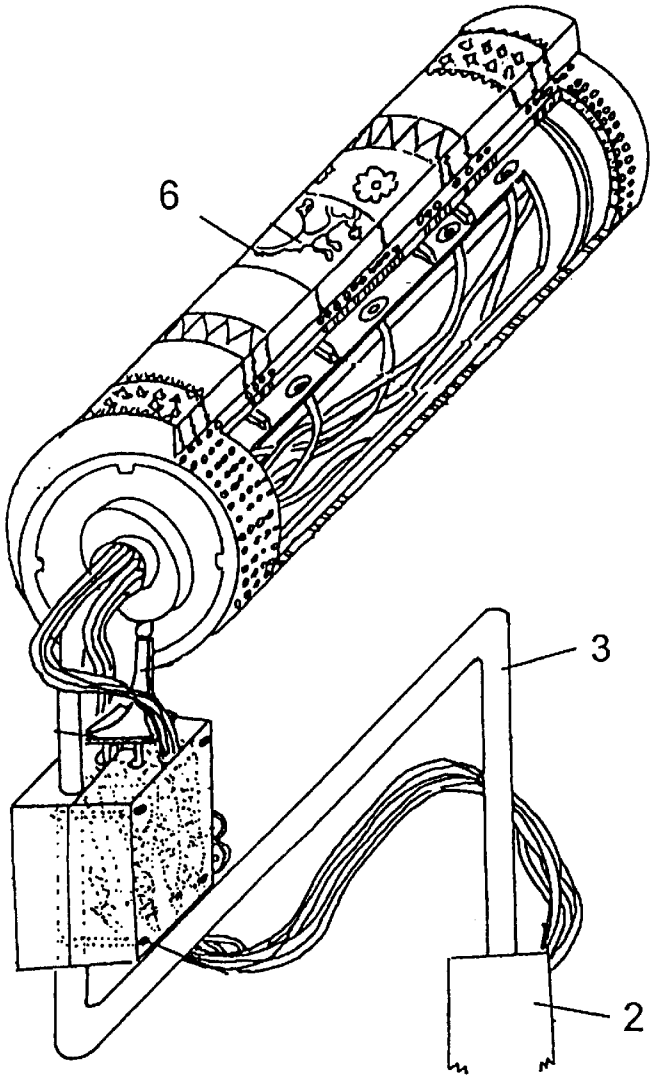
FIG. 7 is a partially sectionalized side view of a painting roller according to an alternative embodiment.
Figure 8:
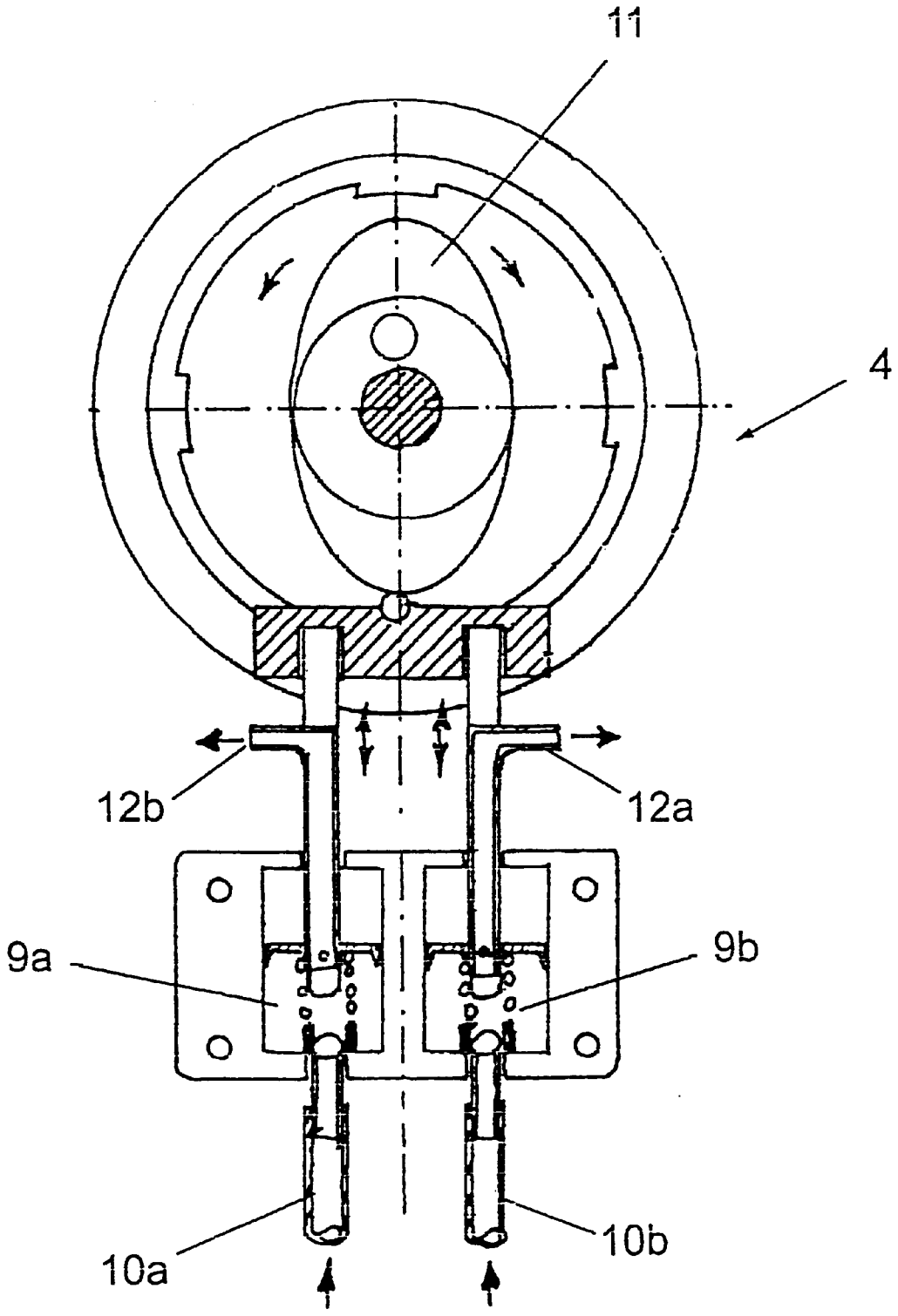
FIG. 8 is a lateral view of a detail of the roller in FIG. 7.
Figure 10:
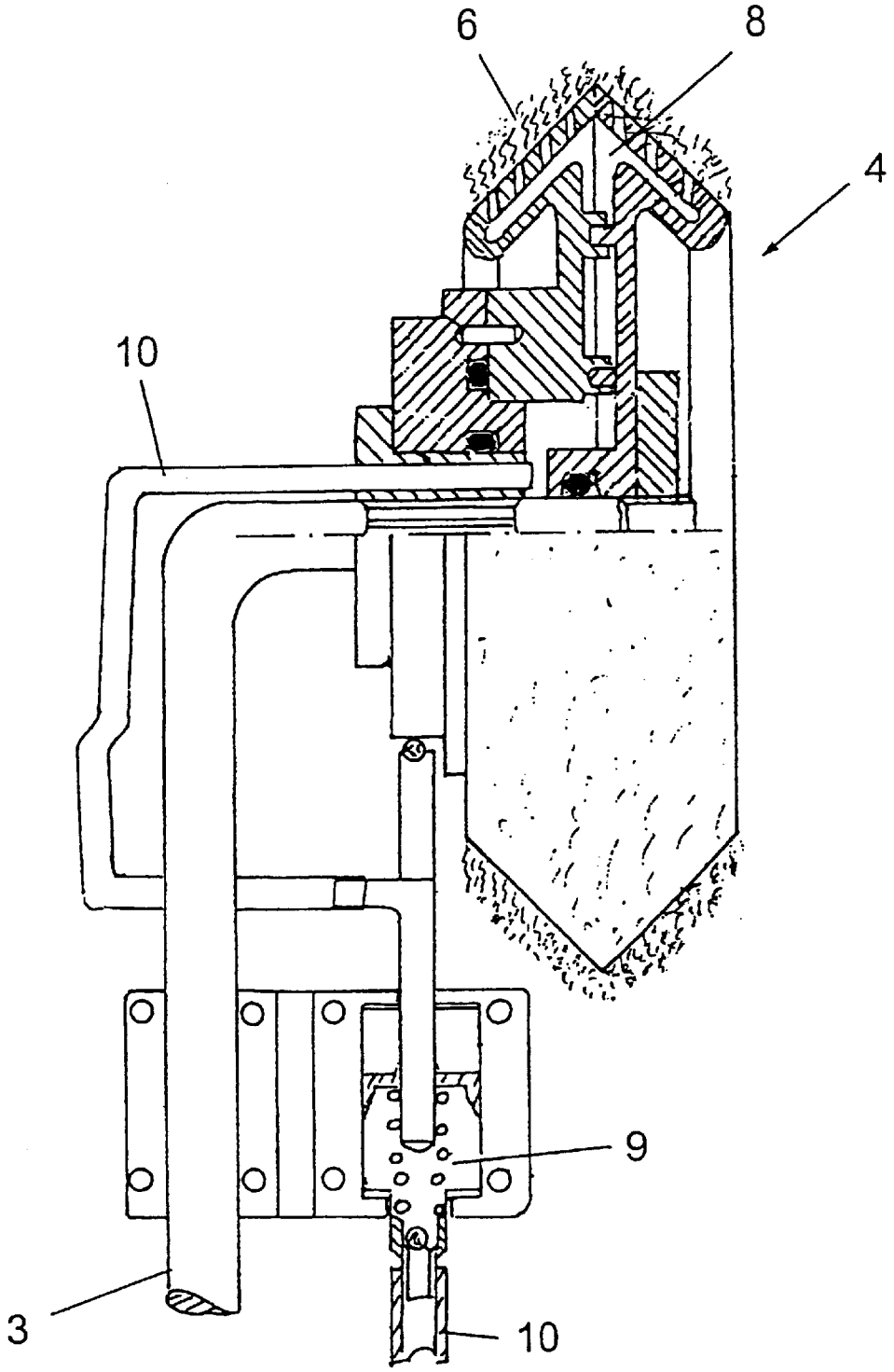
FIG. 10 is a partially sectionalized view of a painting roller according to a further embodiment.

With reference to the figures mentioned above, the number 1 indicates the overall form of a painting roller comprising a handle 2, an appropriately profiled metallic support 3, and a roller mounted on a pair of bushings, mounted in turn on a metallic support 3.

The roller 4 may be entirely coated by an appropriate absorbing material, or alternatively the roller 4 may provide appropriate decorative relief patterns made of an absorbing material, and a non-absorbing surrounding area.

A characteristic of the painting roller described above is that it provides some means 7, 8, 9, 10, 11 and 12 capable of feeding the outer surface 6 of the roller 4 carrying the paint, so as to keep the outer surface of the roller under constantly wetted conditions.

One skilled in the art will immediately grasp the considerable advantages of this solution: in particular, the operator will no longer be obliged to waste time for impregnating the roller with the paint.

A second characteristic of the painting roller is that said means 6, 7, 8, 9, 10, 11, and 12 capable of feeding the roller feed a volume of paint proportional to the angular rotation of the roller 4, so that the roller stays impregnated in an essentially constant manner over a period of time.

Said means 7, 8, 9, 10, 11 and 12 capable of feeding the roller 4 in a manner proportional to the rotation comprise at least one volumetric pump 9 controlled by the rotation of the roller 4.

According to the embodiment shown, said at least one volumetric pump 9 is controlled by an eccentric or cam 11, having one or more lobes and rotating jointly with the roller 4.

According to the preferred embodiment, the paint is aspirated through a suction tube 10, pumped into a chamber 8 inside the roller 4, from where it reaches the outer surface 6 of the roller 4, through a multiple number of radial holes provided in the wall of the roller 4.

According to the embodiment shown, the chamber 8 is defined by the space comprised between the hollow interior of the roller 4, and a coaxial cylindrical inner insert 13; the tightness of the chamber 8 is guaranteed by appropriate gaskets 14. In particular, this characteristic presents the advantage of being able to utilize the roller even in the absence of electrical energy on the work site.

The painting roller described above is preferably further equipped with devices capable of regulating the flow of paint, for instance a butterfly valve 15; this solution conveniently allows regulating the volume of paint being pumped.

Alternatively the painting roller may have two or more inner chambers 8*a* and 8*b*, appropriately divided by suitable partitions, each fed by a separate pump 9*a* and 9*b*; both pumps, however, will preferably be controlled by the same cam 11.

This solution advantageously allows applying several color paints simultaneously; this makes it possible to achieve various color effects quickly and easily.

According to a second embodiment, the roller 4 presents an outer surface split at 90°; this advantageously allows to paint even the corners between walls in a simple and effective manner.

What is claimed is:

1. A painting roller comprising:

a roller having an outer surface capable of painting and mounted on a shaft; a cam mounted on the shaft for movement therewith; and a feed means for feeding the outer surface of the roller with paint, so as to keep the outer surface of the roller constantly impregnated with paint, said feed means comprising a volumetric pump having a pumping member directly contacted by said cam to mechanically drive said pump.

2. A painting roller according to claim 1, in which said feed means for feeding the roller feeds a volume of paint proportional to the angular rotation of the roller so as to keep the surface of the roller impregnated in a manner essentially constant in time.

3. A painting roller according to claim 1, in which said cam has one or more lobes and said cam rotates jointly with the roller.

4. A painting roller according to claim 3, in which the volumetric pump is hydraulically connected to a chamber inside the roller, where said chamber communicates with the outer surface of the roller through appropriate holes.

5. A painting roller according to claim 4, in which said chamber is defined by the space comprised between the hollow interior of the roller, and a coaxial cylindrical inner insert.

6. A painting roller according to claim 4, comprising additional valve means capable of regulating the flow rate of the paint.

7. A painting roller according to claim 4, fitted with two or more inner chambers appropriately divided by partitions, where each chamber is fed by a separate pump.

8. A painting roller according to claim 1, wherein the roller presents an outer surface shaped in a manner capable of applying paint even to the corners between walls.

* * * * *